United States Patent [19]

Jenkins

[11] Patent Number: 4,730,575

[45] Date of Patent: Mar. 15, 1988

[54] COATING OF ARTICLES

[75] Inventor: Leonard A. Jenkins, Newbury, England

[73] Assignee: Metal Box Limited, Wantage, England

[21] Appl. No.: 424,711

[22] Filed: Sep. 27, 1982

Related U.S. Application Data

[60] Division of Ser. No. 906,792, May 17, 1978, which is a continuation-in-part of Ser. No. 704,833, Jul. 13, 1976, abandoned.

[30] Foreign Application Priority Data

Jul. 29, 1975 [GB] United Kingdom ..... 31782/75

[51] Int. Cl.[4] ..... B05C 9/14

[52] U.S. Cl. ..... 118/47; 118/319; 118/322; 118/642

[58] Field of Search ..... 118/47, 642, 643, 66, 118/319, 322; 427/224

[56] References Cited

U.S. PATENT DOCUMENTS

| | | | |
|---|---|---|---|
| 932,609 | 8/1909 | Hodgson | 118/47 |
| 998,900 | 7/1911 | Hodgson | 427/234 X |
| 2,461,657 | 2/1949 | Paasche | 118/319 |
| 3,071,868 | 1/1963 | Kalman | 118/322 X |
| 3,156,580 | 11/1964 | Howard | 427/407 |
| 3,296,999 | 1/1967 | Gamble | 118/322 X |
| 3,802,380 | 4/1974 | Ford et al. | 118/642 X |
| 4,042,317 | 8/1977 | Flynn | 118/47 X |

*Primary Examiner*—John P. McIntosh

*Attorney, Agent, or Firm*—Charles E. Brown

[57] ABSTRACT

A method and apparatus for coating a hollow article with at least two coating materials, said method comprising the steps of applying a first coating material to the article and drying or partially curing at least the surface of the first coating before the application of the second material. Thereafter the two coatings may be fully cured together or alternatively the second coating material may be partially cured in readiness to receive a further coating. The preferred curing means is a gas flame.

4 Claims, 10 Drawing Figures

COATING OF ARTICLES

This is a division of Ser. No. 906,792, filed May 17, 1978, which is a continuation in part of my earlier filed copending application Ser. No. 704,833, filed July 13, 1976, and now abandoned.

This invention relates to the coating of container bodies using two or more coatings at least the first of which is of a cross-linkable material in a solvent.

Containers are known, which are made by drawing sheet metal into thin-walled/cylindrical shapes having one end closed. Such containers are passed through dies which reduce the wall thickness by ironing and in so doing subject the container wall to stresses which could disrupt any surface coatings thereon. It is therefore customary to coat such containers after forming. The coating may be in the form of a base coating and subsequent printed coatings. It is customary to stove each coating in an oven to cure each coat completely before the application of the next coating.

According to one aspect, this invention provides a method of coating a container body with at least two coatings, wherein a first coating is applied to the body, the first coating is substantially dried but only partially cured sufficiently to render it stable enough to receive a second coating thereon, a said second coating is applied to the body on top of at least part of the first coating and the first and second coatings are subsequently fully cured.

In this specification the word "cured" is used in relation to a cross-linkable coating and deemed to indicate that no further cross-linking of the coating material is possible; "partially cured" therefore means that further cross-linking of the coating material is possible. The word "dried" is used in relation to a coating having solvents and indicates that the solvents have been driven off.

In a preferred embodiment of the method the first coating is of a base coating material and the second coating is of a printing ink. The combination of coatings may be further stoved to a completely cured condition.

In a further aspect the invention provides apparatus for drying or partially curing a coating on a container, said apparatus including a curing means for drying or partially curing the coating, and container movement means for presenting a coating on the container to the drying or curing means.

In a preferred embodiment the curing means comprises a gas flame. The container movement means may be arranged to effect the container movement mechanically, pneumatically or electrically, along a linear or curved path.

Various embodiments will now be described by way of example and with reference to the accompanying drawings in which:

FIG. 1 is a block diagram illustrating a prior art method of coating;

FIG. 2 similarly illustrates one embodiment of the invention;

Figure 1:
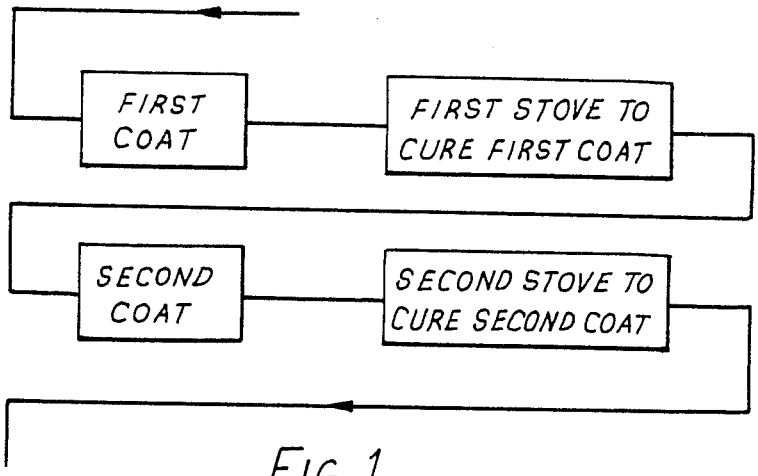

Referring to FIG. 1, during the conventional manufacture of wall ironed cans the cans are first coated with a base coating material and then passed to an oven where the coating is cured. A second coating is then applied on top of the base coating, whereafter the cans are passed to a second oven for curing of the second coating before any subsequent coatings are applied or additional operations performed as desired.

Typical gas fired ovens for such known stoving operations comprise a thermally insulated tunnel oblong in cross section. A chain having horizontal pegs, one for each can, passes through the oven. Such ovens have a large volume and require considerable amounts of energy to heat them. A typical stoving cycle for can coatings or print would include a period of 2 minutes at 205° C., and time for raising and lowering the temperature of the can to make a total time in the oven of up to 6 minutes, dependant upon line speed. Such extended stoving results in fully cured coatings which are completely cross-linked.

Applicant has discovered that coating need only be dried or partially cured before the application of a further coating thereon. In the method shown diagrammatically in FIG. 2 a first coating is applied to a can and then dried or cured to produce a surface stable enough to permit the application of a second coating. The drying or curing of the first coating may be induced by heat from a gas flame. The second coating may be dried or cured in readiness to receive further coatings (as shown by the continuous line) or alternatively the combination of first and second coatings may be stoved to completely dry or cure both coatings (as indicated by the dashed line).

Suitable conditions for achieving the desired degree of drying or curing depend on the characteristics of the coating materials used (e.g. base coatings, printing inks, or varnishes or lacquers). However, it has been found that by using the method of FIG. 2 the drying or curing time required can be reduced to the order of seconds from the minutes required in the prior art method. Preferred coating materials will require less than 10 seconds.

The temperature of the flame used to bring about the desired degree of drying or partial curing is high and in order to prevent scorching or ignition of the coatings, the coated surfaces of the cans are passed rapidly before the flame.

Ideally, it is only necessary to heat the coating and not the can, so less heat should be necessary than in prior art methods where the whole can is heated.

FIGS. 3A, 3B, 4A, 4B, 5A and 5B show apparatus to illustrate, by way of non-limiting examples, ways in which the coatings on a can body may be presented to a flame.

Figure 3A:
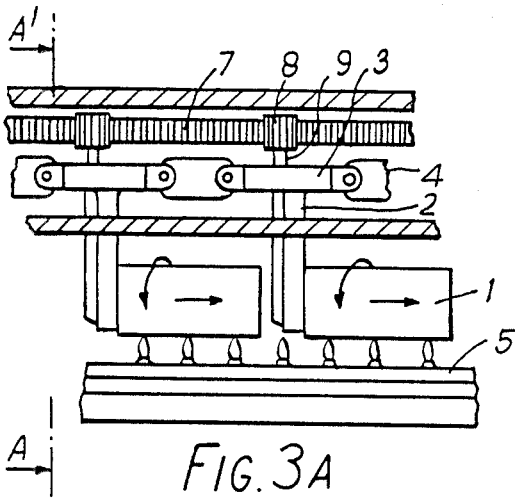
FIG. 3A is a side elevation of a first apparatus arranged for putting the method of FIG. 2 into effect and in which a container being coated is conveyed along a linear path.
Figure 3B:
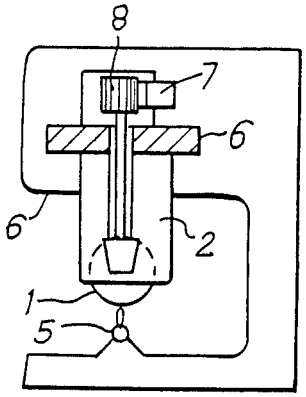
FIG. 3B is an end elevation of the apparatus, taken on line A—A' in FIG. 3A.

Referring to FIG. 3A it will be seen that the apparatus has can carrying mandrels (such as that denoted at 1) which are each carried on the arm 2 of a chain link 3. Linear movements of the chain 4 move the mandrels along and above a burner 5. Guides 6, best seen in FIG. 3B, are provided to control the spacing of the mandrels above the burner bar. Each mandrel 1 is rotated about its axis which is substantially parallel with the burner bar 5. Rotation is derived from a stationary rack 7 and pinions such as 8 which are attached to a shaft 9 on each of the arms 2. Suitable bevelled gears attached to the shaft 9 are used to rotate each mandrel 1. The temperature to which the coating is raised is governed by the characteristics of the flames from the burner 5 and the time of impingement. The time of impingement is controlled either by the rate of linear passage of the mandrels over the burner or the length of the burner, or a combination of these parameters.

Figure 4A:
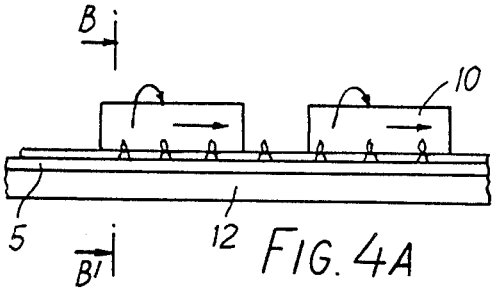
FIG. 4A is a side elevation of a second apparatus in accordance with the invention in which the container being coated is conveyed along a linear path.
Figure 4B:
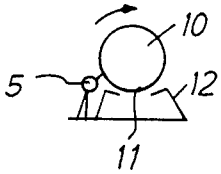
FIG. 4B is an end elevation of the apparatus of FIG. 4A, taken on the line B—B' of that figure.

Referring to FIGS. 4A and 4B, a can body 10 is shown carried by an air conveyor 12. Such conveyors are known in which the cans are carried by air issuing from an elongated orifice 11 above a plenum chamber of the conveyor 12. By suitable adaption of the conveyor it is possible not only to convey each can along the conveyor but also rotate it before impinging flames from a burner 5, thereby providing the conditions for the required degree of drying or partial curing according to the invention as already described. Alternatively hot air may be used not only to convey the cans but also partially cure the coating. The degree of curing is controlled by controlling the temperature of the flame or hot air and the time the coating is exposed to the heat.

Figure 5A:
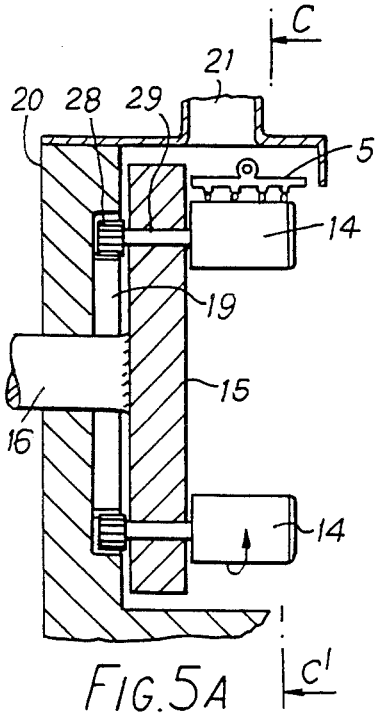
FIG. 5A is a side elevation of a third apparatus in accordance with the invention in which the container being coated is conveyed along a curved path.
Figure 5B:
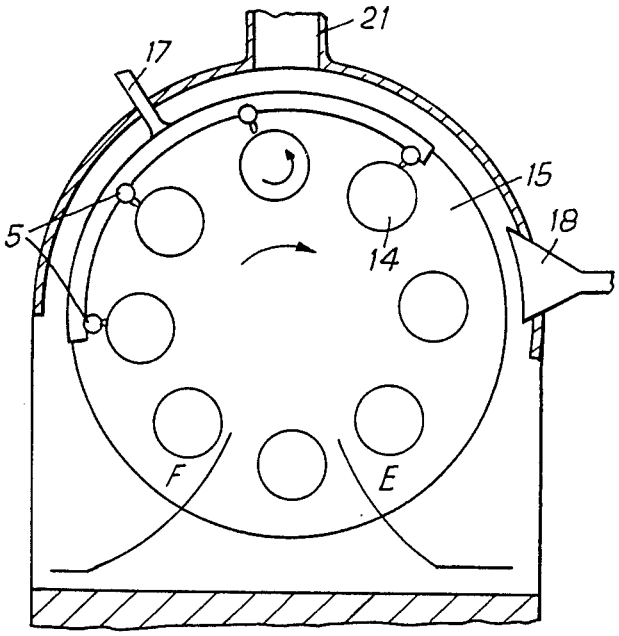
FIG. 5B is a front elevation of the apparatus of FIG. 5A taken on line C—C' of that figure.

Referring to FIG. 5A, a rotary apparatus is shown in which a plurality of mandrels, such as the two denoted 14 and depicted, are rotatably mounted on a rotating hub 15 which is mounted on a shaft 16 driven by known means. As the hub rotates, as shown in FIG. 5B, each mandrel passes a feed position F at which a coated can body is fed onto it. As rotation of the hub 15 continues, each can is therefore carried to pass, while rotating on its axis, before a burner having a plurality of bars 5. In FIG. 5B the burner has a main supply pipe 17 through which gas is fed to the burner bars such as those denoted at 5. It is thought that there may be some advantage in the cyclic heating and cooling applied to the coating on a can as it passes from bar to bar. As described previously the parameters of temperature and time of exposure are controlled to achieve partial curing.

After heating to effect the desired degree of drying or partial curing of the coating, the can body may optionally be carried through a cooling location in which cold air is directed onto the surface of the can body from a nozzle 18.

Figure 2:
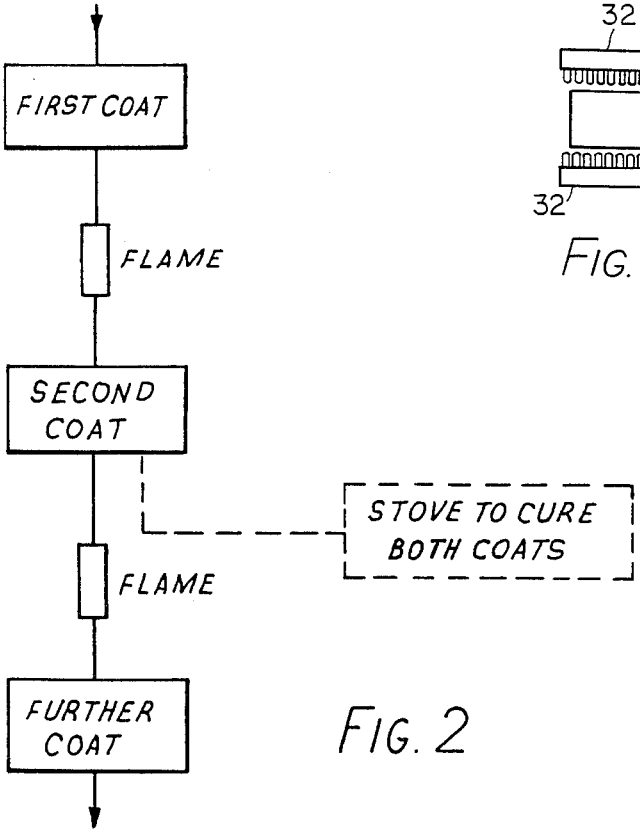

Thereafter each can is removed from the mandrel and ejected from the machine at a position E, and one or more further coatings are applied and dried or completely cured as described in relation to the method of FIG. 2.

In FIG. 5A, each mandrel 14 is carried by a shaft 29 mounted on the hub 15 and carrying a pinion 28 which coacts with a gear wheel 19 fixed to the machine frame 20, so that as the hub 15 rotates, each mandrel is rotated continuously, so permitting the entire surface coating of each can carried thereon to be presented, by rotation, to the burners. A flue 21 is provided to conduct the fumes, if any, away from the machine.

Figure 6:
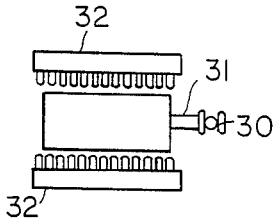
FIG. 6 is a fragmentary horizontal sectional view taken through a fourth apparatus of the invention in which the container is moved vertically between two horizontal opposed burners.

Referring now to FIG. 6, it will be seen that there is illustrated a fourth type of curing apparatus which may simply be in the form of a pair of horizontally disposed burners 32 which are spaced apart for vertical movement therebetween of a can having coating material thereon to be cured. The can is moved vertically between the burners 32 by a vertical run of a conveyor 30 having pins 32 for supporting the cans.

The apparatus is designed to provide a burner face to can wall distance of 5 centimeters and a burner face to can base rim distance of 4.5 centimeters. The reduced distance of the burner face to the can base rim overcomes the heat sink effect of the heavy metal base.

The principle of the invention can be demonstrated by means of a simple apparatus (not shown) in which a rotatable mandrel or fixed peg adapted to receive a container is used to present the container before a gas burner. A can having a wet base coating of an organic resin coating material selected from the following Table 1 was placed on the mandrel and rotated at a high speed, e.g. 900 revolutions per minute. Flames from the burner bar are brought to impinge upon the surface of the base coating for a period of 1.3 seconds to dry or partially cure the coating. The coating so produced is capable of receiving a subsequent coating of either a suitable varnish or a suitable printing ink such as is customarily utilized by can manufacturers with typical examples being found in the following Tables 2 and 3A and B.

TABLE 1

Organic coatings supplied by Ault and Wiborg Ltd.

| | Ref. No. | Type | Wt. % Solids | Thinner |
|---|---|---|---|---|
| Solvent Based | W885 | Acrylic | 53.5 | Glycol Ether |
| Solvent Based | W900 | Acrylic | 58 | Butyl Oxitol |
| Solvent Based | W901 | Acrylic | 58 | Oxitol |
| Water Thinnable | W886 | Acrylic | 53 | Water |
| Water Thinnable | W872 | Polyester | 67 | Water |

TABLE 2

Varnishes supplied by Ault and Wiborg Ltd.

| | Ref. No. | Type | Wt. % Solids | Thinner |
|---|---|---|---|---|
| Solvent Based | W877 | Acrylic | 49 | Glycol Ether |
| Water Thinnable | W775 | Alkyd | 40 | Water |
| Water Thinnable | W878 | Acrylic | 38 | Water |

TABLE 3

PRINTING INKS

| Supplier | Ref. No. |
|---|---|
| (A) Short oil isophthalic alkyd based inks | |
| E. Marsden Ltd. | N65123 |
| Fishburn Ink Co. Ltd. | FR 1965 |
| Fishburn Ink Co. Ltd. | FS 1645 |
| Fishburn Ink Co. Ltd. | FU 485 |
| Coates Bros. Ltd. | M 2606 |
| Coates Bros. Ltd. | M 2067 |
| (B) Polyester based inks | |
| Ault and Wiborg Ltd. | K 4019 |
| Ault and Wiborg Ltd. | K 4021 |
| Coates Bros. Ltd. | M 3180 |
| Fishburn Ink Co. Ltd. | FR 2080 |
| Fishburn Ink Co. Ltd. | FU 535 |

The coating materials used may be known materials or alternatively may be modified by the addition of a high level of a conventional lubricant used in can body manufacturing incorporated to produce a high degree of slip in the coating which aids subsequent conveying of the cans.

When base coatings having high levels of the conventional lubricant are stoved in the manner of the prior art, the lubricant residing on the surface after the relatively low temperature curing interferes with the deposition of further coatings. However, if the method shown in FIG. 2 is used, any residual lubricant in or near the surface of the base coating is driven off so leaving the surface free of lubricant initially, allowing a second coating to be applied without adhesion or application problem before the lubricant in the first coating film migrates to the surface.

HEAT INPUT

Figure 7:
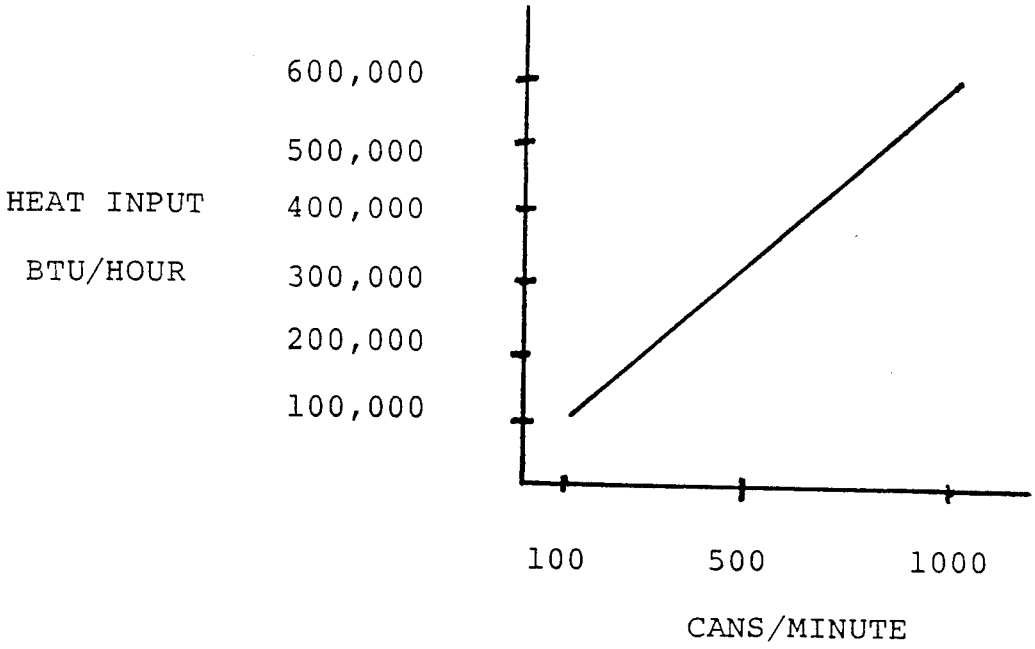
FIG. 7 is a graph showing target heat input for a particular can speed.

All coatings, varnishes and inks were designed to fall within a target heat input for a particular can speed as indicated by the graph of FIG. 7.

From the foregoing, it will be seen that the limits of the target heat input rise from an input of 110,000 BTU per hour at the rate of 100 cans per minute to 580,000 BTU per hour at the rate of 1000 cans per minute in a linear manner. Thus at the rate of 1000 cans per minute, 600,000 coated cans could have the coating thereon sufficiently hardened with a heat input of 580,000 BTU.

The sequence of drying/curing at the 1000 cans per minute rate would be typical as follows: base coating W900 applied at the rate of 7 MGS per square inch is flame dried at a 580,000 BTU per hour input with there being a typical flame exposure time of 1–1.5 seconds. In such an arrangement the flame chamber would have a length of 5.5 feet.

A typical printing ink would be FR2080 which is applied over the base coating at a thickness of 3–4 microns and flame dried at the same rate as the base coating.

If the can is provided with an internal lacquer coating, which is typically vinyl and spray applied, the can would have to be stoved conventionally for 30 seconds at 400° F. in hot air.

I claim:

1. Apparatus for coating a can body, said apparatus comprising a first coating means for applying a first coating to a can body; a flame source defining means for heating and partially curing and hardening a first coating, support means for exposing said can body having a first coating thereon to the flame with the flame directly impinging on the first coating to partially cure and harden the first coating; second coating means for applying a second fluid coating to the first coating while it is only partially cured and hardened; and means for receiving a can body having a second coating over a partially cured and hardened first coating and fully curing the first and second coatings simultaneously.

2. Apparatus according to claim 1 wherein the support means includes a rotatable mandrel and drive means for rotating said mandrel.

3. Apparatus according to claim 1 wherein said flame source includes a plurality of burner bars disposed in adjacent relation, and said support means includes a hub mounted for rotation and carrying at least one shaft for movement past said burner bars, a mandrel rotatably mounted on said shaft, and means for effecting rotation of said mandrel.

4. Apparatus according to claim 3 wherein said burner bars are spaced to provide cooling between adjacent burner bars.

* * * * *